US006726076B1

(12) United States Patent
Hernandez

(10) Patent No.: US 6,726,076 B1
(45) Date of Patent: Apr. 27, 2004

(54) PORTABLE LITTER RECEPTACLE

(76) Inventor: Eric C. Hernandez, 4924 S. Karlov, Chicago, IL (US) 60632

( * ) Notice: Subject to any disclaimer, the term of this patent is extended or adjusted under 35 U.S.C. 154(b) by 0 days.

(21) Appl. No.: 09/853,484

(22) Filed: May 11, 2001

(51) Int. Cl.[7] ..... B65D 33/24; A45C 1/04

(52) U.S. Cl. ..... 224/675; 229/84; 383/22; 383/33; 383/86

(58) Field of Search ..... 383/7, 86, 33, 383/22, 23, 12; 229/84; 224/674, 675

(56) References Cited

U.S. PATENT DOCUMENTS 1,110,019 A * 9/1914 Webb ..... 229/84
1,224,568 A * 5/1917 Ream ..... 383/12
2,165,869 A * 7/1939 Mathiesen ..... 383/12
2,234,402 A 3/1941 Frankenstein
2,281,452 A * 4/1942 Ottinger ..... 229/68.1
2,524,352 A * 10/1950 Kiser ..... 383/12
2,778,554 A * 1/1957 Porkola ..... 224/553
2,936,105 A * 5/1960 La Marche ..... 383/23
2,944,555 A 7/1960 Peel et al.
3,133,690 A * 5/1964 Lui ..... 383/106
3,300,164 A * 1/1967 Welles ..... 248/205.3
3,425,618 A * 2/1969 Cohen ..... 383/9
3,426,958 A * 2/1969 Gore ..... 206/806
3,508,700 A * 4/1970 Kelly ..... 206/806
3,561,670 A 2/1971 Segal
3,655,036 A * 4/1972 Corelli et al. ..... 206/526
3,779,496 A * 12/1973 Welles ..... 248/99
4,101,104 A * 7/1978 Minard ..... 248/205.3
4,577,758 A 3/1986 Gilda et al.
4,694,503 A * 9/1987 Hydorn ..... 383/12
4,896,825 A 1/1990 Moeller
D307,947 S 5/1990 Wells et al.
5,031,808 A * 7/1991 Dolenc ..... 224/280
5,118,019 A * 6/1992 Harrison ..... 224/555
5,683,019 A * 11/1997 Schaber ..... 224/191
5,911,324 A * 6/1999 Hammer ..... 206/460
5,915,839 A * 6/1999 Dennis ..... 383/11

* cited by examiner

*Primary Examiner*—Stephen P. Garbe

(57) ABSTRACT

A portable litter receptacle for allowing smokers to discard their litter in a litter receptacle rather than throwing their buds on the ground. The portable litter receptacle includes a pouch member being collapsible; and also includes a support assembly being securely attached to the.pouch member and being adapted to extend over an object to suspend the pouch member therefrom.

5 Claims, 5 Drawing Sheets

PORTABLE LITTER RECEPTACLE

BACKGROUND OF THE INVENTION

1. Field of the Invention

The present invention relates to a collapsible and portable ashtray and more particularly pertains to a new portable litter receptacle for allowing smokers to discard their litter in a litter receptacle rather than throwing their buds on the ground.

2. Description of the Prior Art

The use of a collapsible and portable ashtray is known in the prior art. More specifically, a collapsible and portable ashtray heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,944,555; U.S. Pat. No. Des. 307,947; U.S. Pat. No. 2,234,402; U.S. Pat. No. 3,561,670; U.S. Pat. No. 4,577,758; and U.S. Pat. No. 4,896,825.

While these devices fulfill their respective, particular objectives and requirements, the aforementioned patents do not disclose a new portable litter receptacle. The inventive device includes a pouch member being collapsible; and also includes a support assembly being securely attached to the pouch member and being adapted to extend over an object to suspend the pouch member therefrom.

In these respects, the portable litter receptacle according to the present invention substantially departs from the conventional concepts and designs of the prior art, and in so doing provides an apparatus primarily developed for the purpose of allowing smokers to discard their litter in a litter receptacle rather than throwing their buds on the ground.

SUMMARY OF THE INVENTION

In view of the foregoing disadvantages inherent in the known types of collapsible and portable ashtray now present in the.prior art, the present invention provides a new portable litter receptacle construction wherein the same can be utilized for allowing smokers to discard their litter in a litter receptacle rather than throwing their buds on the ground.

The general purpose of the present invention, which will be described subsequently in greater detail, is to provide a new portable litter receptacle which has many of the advantages of the collapsible and portable ashtray mentioned heretofore and many novel features that result in a new portable litter receptacle which is not anticipated, rendered obvious, suggested, or even implied by any of the prior art collapsible and portable ashtray, either alone or in any combination thereof.

To attain this, the present invention generally comprises a pouch member being collapsible; and also includes a support assembly being securely attached to the pouch member and being adapted to extend over an object to suspend the pouch member therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable litter receptacle which has many of the advantages of the collapsible and portable ashtray mentioned heretofore and many novel features that result in a new portable litter receptacle which is not anticipated, rendered obvious, suggested, or even implied by any of the prior art collapsible and portable ashtray, either alone or in any combination thereof.

It is another object of the present invention to provide a new portable litter receptacle which may be easily and efficiently manufactured and marketed.

It is a further object of the present invention to provide a new portable litter receptacle which is of a durable and reliable construction.

An even further object of the present invention is to provide a new portable litter receptacle which is susceptible of a low cost of manufacture with regard to both materials and labor, and which accordingly is then susceptible of low prices of sale to the consuming public, thereby making such portable litter receptacle economically available to the buying public.

Still yet another object of the present invention is to provide a new portable litter receptacle which provides in the apparatuses and methods of the prior art some of the advantages thereof, while simultaneously overcoming some of the disadvantages normally associated therewith.

Still another object of the present invention is to provide a new portable litter receptacle for allowing smokers to discard their litter in a litter receptacle rather than throwing their buds on the ground.

Yet another object of the present invention is to provide a new portable litter receptacle which includes a pouch member being collapsible; and also includes a support assembly being securely attached to the pouch member and being adapted to extend over an object to suspend the pouch member therefrom.

Still yet another object of the present invention is to provide a new portable litter receptacle that is easy and convenient not only to use but also to take along and use when needed.

Even still another object of the present invention is to provide a new portable litter receptacle that effectively keeps the environment clean so that smokers don't throw their buds anywhere on the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
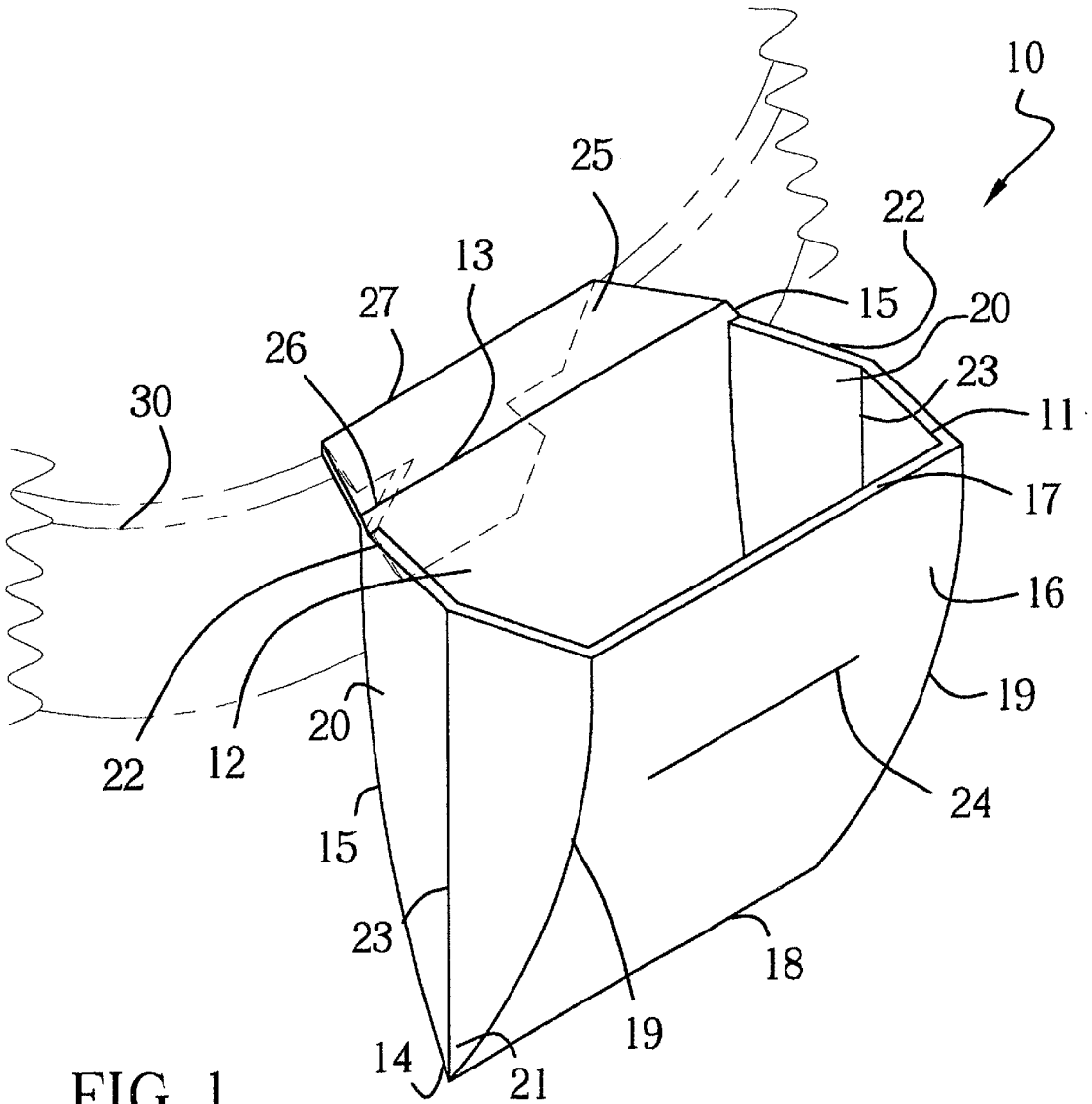
FIG. 1 is a perspective view of a new portable litter receptacle according to the present invention and shown in use.
Figure 2:
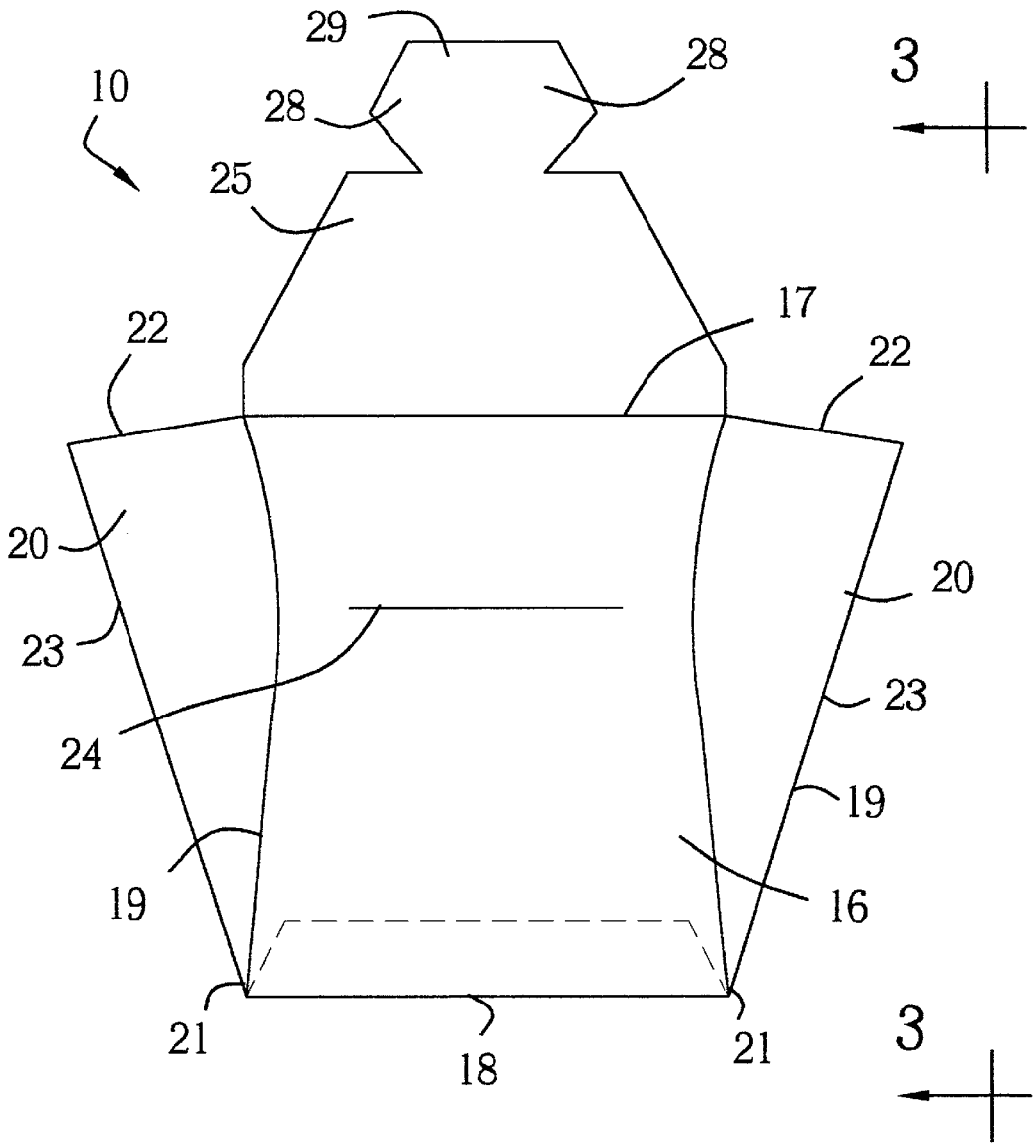
FIG. 2 is a front elevational view of the present invention.
Figure 3:
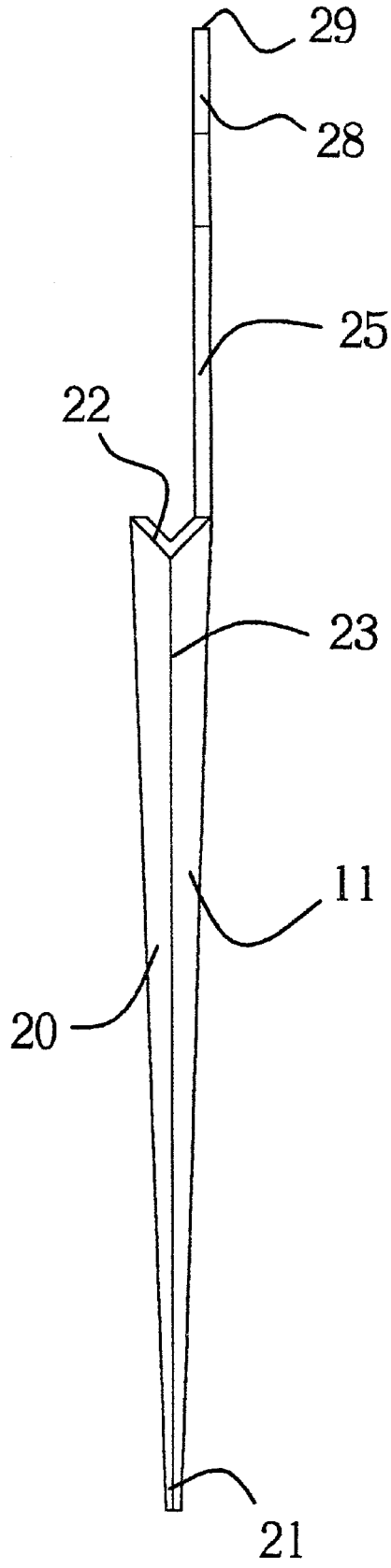
FIG. 3 is a side elevational view of the present invention shown in a folded position.
Figure 4:
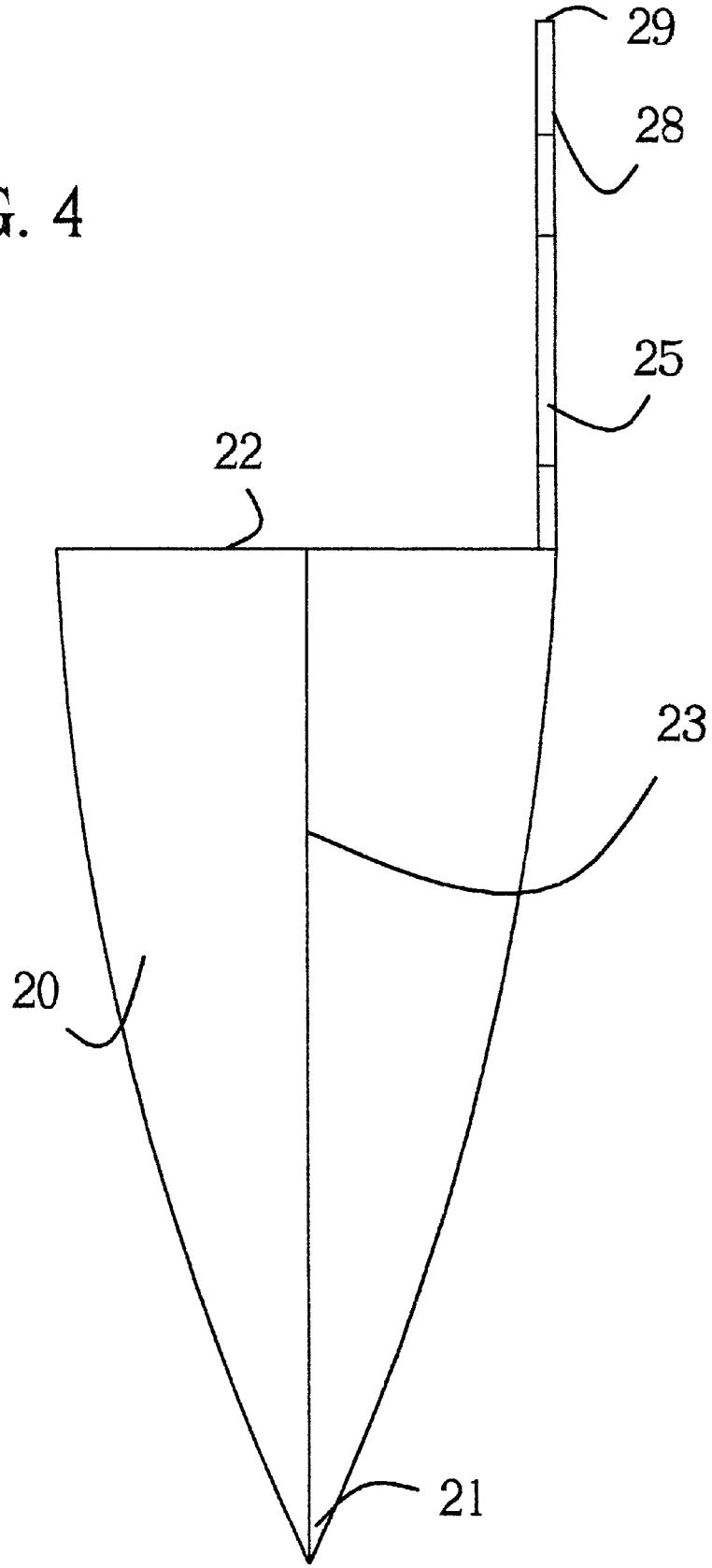
FIG. 4 is a side elevational view of the present invention shown in a unfolded position.
Figure 5:
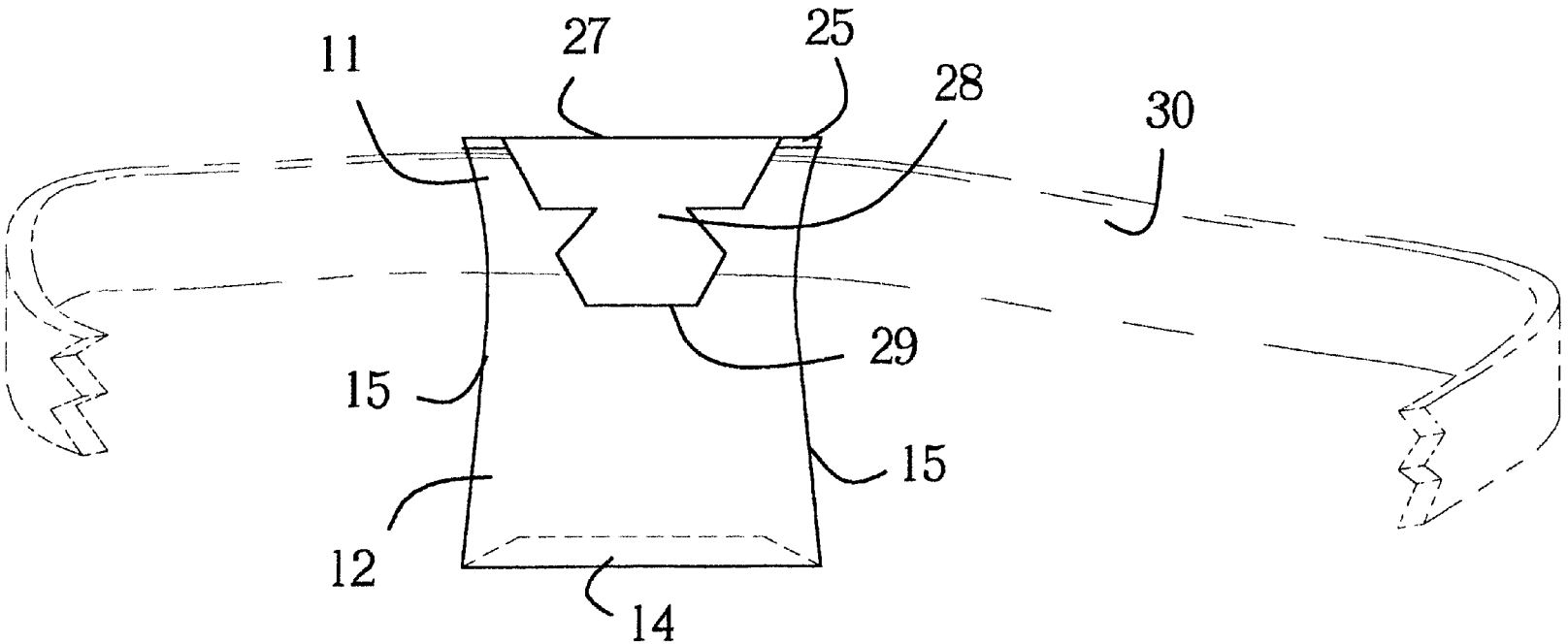
FIG. 5 is a rear elevational view of the present invention shown in use.

With reference now to the drawings, and in particular to FIGS. 1 through 5 thereof, a new portable litter receptacle embodying the principles and concepts of the present invention and generally designated by the reference numeral 10 will be described.

As best illustrated in FIGS. 1 through 5, the portable litter receptacle 10 generally comprises a pouch member 11 being collapsible and having an open top and including a back wall 12 having a top end 13, side ends 15, and a bottom end 14, and also including a front wall 16 also having a top end 17, side ends 19, and a bottom end 18 which is securely and conventionally attached to the bottom end 14 of the back wall 12, and further including side walls 20 each having a top end 22, and a bottom end 21. The side walls 20 are tapered from the top end 22 to the bottom end 21 thereof. The front wall 16 is generally bowed outwardly relative to the back wall 12 and has a lateral-extending slit 24 disposed therethrough. Each of the side walls 20 has a longitudinal fold 23 extending from the top end 22 to the bottom end 21 thereof and symmetrically dividing the side wall 20 into front and rear sections with the front and rear sections being collapsible upon one another to essentially collapse the pouch member 11. The pouch member 11 has a length of approximately 3 inches and a width of approximately 2½ inches.

A support assembly is securely and conventionally attached to the pouch member 11 and is adapted to extend over an object 30 to suspend the pouch member 11 therefrom. The support assembly includes a flap member 25 having a first edge 26 which is securely and conventionally attached to the top end 13 of the back wall 12 of the pouch member 11 and which is foldable relative to the back wall 12, and also includes a tab-like member 28 being securely and conventionally attached to a second edge 27 of the flap member 25 opposite to the first edge 26 and being foldable relative to the flap member 25. The tab-like member 28 and the flap member 25 are adapted to extend upon and about an object such as a belt 30 to removably clip the pouch member 11 to the belt 30. The tab-like member 28 is tapered from the second edge 27 of the flap member 25 to an outer edge 29 of the tab-like member 28, and is slotted along side edges thereof.

In use, the user expands the pouch member 11 by moving the front and back walls 12,16 away from one another with the side walls 20 being unfolded, and the user then folds the flap member 25 and the tab-like member 28 over one's belt 30 to suspend the pouch member 11 from the belt 30 so that the user can discard one's buds into the pouch member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable litter receptacle comprising:

a pouch member being collapsible and having an open top; and a support assembly being securely attached to said pouch member and being adapted to extend over an object to suspend said pouch member therefrom;

wherein said pouch member comprises:

a back wall having a top end, side ends, and a bottom end;

a front wall also having a top end, side ends, and a bottom end, said bottom end of said front wall being attached to said bottom end of said back wall; and side walls each having a top end, and a bottom end, said side walls being tapered from said top end to said bottom end thereof; and wherein said front wall is generally bowed outwardly relative to said back wall;

wherein said front wall has a lateral-extending slit disposed therethrough, each of said side walls having a longitudinal fold extending from said top end to said bottom end thereof and symmetrically dividing said side wall into front and rear sections, said front and rear sections being collapsible upon one another to essentially collapse said pouch member, said pouch member having a length of approximately 3 inches and a width of approximately 2½ inches; and wherein said support assembly includes a flap member having a first edge which is securely attached to said top end of said back wall of said pouch member and which is foldable relative to said back wall, and also including a tab-like member being securely attached to a second edge of said flap member opposite to said first edge and being foldable relative to said flap member, said tab-like member and said flap member being adapted to extend upon and about an object such as a belt to removably clip said pouch member to the belt, said tab-like member being tapered from said second edge of said flap member to in outer edge of said tab-like member, and being slotted along side edges thereof.

2. A portable litter receptacle comprising:

a pouch member being collapsible and having an open top; and a support assembly being securely attached to said pouch member and being adapted to extend over an object to suspend said pouch member therefrom;

wherein said pouch member includes a back wall having a top end, side ends, and a bottom end, and also includes a front wall also having a top end, side ends, and a bottom end which is securely attached to said bottom end of said back wall, and further includes side walls each having a top end, and a bottom end, said side walls being tapered from said top end to said bottom end thereof;

wherein said front wall is generally bowed outwardly relative to said back wall and has a lateral-extending slit disposed therethrough.

3. A portable litter receptacle as described in claim 2, wherein each of said side walls has a longitudinal fold extending from said top end to said bottom end thereof and symmetrically dividing said side wall into front and rear sections, said front and rear sections being collapsible upon one another to essentially collapse said pouch member.

4. A portable litter receptacle as described in claim 2, wherein said support assembly includes a flap member having a first edge which is attached to said top end of said back wall of said pouch member and which is foldable relative to said back wall, and also includes a tab member being securely attached to a second edge of said flap member opposite to said first edge and being foldable relative to said flap member, said tab member and said flap member being adapted to extend upon and about an object such as a belt to removably clip said pouch member to the belt.

5. A portable litter receptacle comprising:

a pouch member being collapsible and having an open top; and a support assembly being securely attached to said pouch member and being adapted to extend over an object to suspend said pouch member therefrom;

wherein said pouch member includes a back wall having a top end, side ends, and a bottom end, and also includes a front wall also having a top end, side ends, and a bottom end which is securely attached to said bottom end of said back wall, and further includes side walls each having a top end, and a bottom end, said side walls being tapered from said top end to said bottom end thereof;

wherein said support assembly includes a flap member having a first edge which is securely attached to said top end of said back wall of said pouch member and which is foldable relative to said back wall, and also includes a tab-like member being securely attached to a second edge of said flap member opposite to said first edge and being foldable relative to said flap member, said tab-like member and said flap member being adapted to extend upon and about an object such as a belt to removably clip said pouch member to the belt;

wherein said tab-like member is tapered from said second edge of said flap member to an outer edge thereof, and is slotted along side edges thereof.

* * * * *